US010837171B2

(12) United States Patent
Bianchi

(10) Patent No.: US 10,837,171 B2
(45) Date of Patent: Nov. 17, 2020

(54) SPACER ELEMENT FOR A DISPOSABLE FORMWORK FOR THE CONSTRUCTION OF WALLS AND DISPOSABLE FORMWORK INCORPORATING THE SPACER ELEMENT

(71) Applicant: FLEX HOUSE SRL, Jesi (AN) (IT)

(72) Inventor: Attilio Bianchi, Jesi (IT)

(73) Assignee: FLEX HOUSE SRL, Jesi (IT)

( * ) Notice: Subject to any disclaimer, the term of this patent is extended or adjusted under 35 U.S.C. 154(b) by 0 days.

(21) Appl. No.: 16/070,187

(22) PCT Filed: Jan. 12, 2017

(86) PCT No.: PCT/IB2017/000013

§ 371 (c)(1),
(2) Date: Jul. 13, 2018

(87) PCT Pub. No.: WO2017/122082

PCT Pub. Date: Jul. 20, 2017

(65) Prior Publication Data

US 2019/0024394 A1 Jan. 24, 2019

(30) Foreign Application Priority Data

Jan. 14, 2016 (IT) ..... 102016000003043

(51) Int. Cl.
*E04B 2/86* (2006.01)

(52) U.S. Cl.
CPC ..... *E04B 2/8635* (2013.01); *E04B 2/8658* (2013.01)

(58) Field of Classification Search
CPC .... E04B 2/8635; E04B 2/8658; E04G 17/054
(Continued)

(56) References Cited

U.S. PATENT DOCUMENTS 1,896,053 A * 1/1933 Fisk ..... E04B 1/84 454/271
2,223,016 A * 11/1940 Parkhurst ..... E04B 1/04 52/22

(Continued)

FOREIGN PATENT DOCUMENTS

EP 1 544 380 A2 6/2005
FR 2328814 A1 * 5/1977 ..... E04B 2/8641

(Continued)

OTHER PUBLICATIONS

International Search Report, dated Apr. 5, 2017, from corresponding PCT/IB2017/000013 application.

*Primary Examiner* — Michael Safavi
(74) *Attorney, Agent, or Firm* — Nixon & Vanderhye

(57) ABSTRACT

Disclosed is a spacer for a disposable formwork for the construction of a wall, with first and second panels. The spacer mutually couples the first and second panels at a certain distance one from the other. The spacer includes: a first connecting portion coupled, in use, with the first panel; a second connecting portion opposite the first and coupled, in use, with the second panel; and at least one pipe with at least one lateral opening communicating, in use, outside the formwork. In the pipe a through hole communicates, in use, with the formwork interior, allowing air passage from the outside towards the inside part and liquid outflow from inside towards the outside of the formwork. Also disclosed is a disposable formwork for the construction of a wall, including two panels and at least one such spacer, arranged between the two panels and coupling the two panels.

1 Claim, 7 Drawing Sheets

(58) Field of Classification Search
USPC ..... 249/213, 216; 52/424, 425, 426, 427, 52/442, 169.5; 454/243, 271, 270
See application file for complete search history.

(56) References Cited

U.S. PATENT DOCUMENTS

| | | | | | |
|---|---|---|---|---|---|
| 2,491,460 | A | * | 12/1949 | Turzillo | E04G 17/0658 249/42 |
| 2,703,911 | A | * | 3/1955 | Griffin | E04B 1/7076 52/302.3 |
| 2,840,867 | A | * | 7/1958 | Wilder | E04B 1/7076 29/282 |
| 4,043,087 | A | * | 8/1977 | Connors | E04G 11/28 52/127.3 |
| 4,587,891 | A | * | 5/1986 | Kruse | E04B 1/7076 454/271 |
| 4,655,014 | A | * | 4/1987 | Krecke | E04B 2/8641 52/105 |
| 5,399,050 | A | * | 3/1995 | Jacobus | E02D 27/00 249/13 |
| 6,159,399 | A | | 12/2000 | Schmid | |
| 8,627,615 | B2 | * | 1/2014 | Moyher | E02D 19/00 249/34 |
| 2012/0233950 | A1 | | 9/2012 | Carr et al. | |
| 2015/0275531 | A1 | | 10/2015 | Alcala Ordaz | |

FOREIGN PATENT DOCUMENTS

| | | | | | |
|---|---|---|---|---|---|
| WO | WO-9806911 | | * | 2/1998 | E04B 2/8617 |
| WO | 2014/042502 | A1 | | 3/2014 | |
| WO | 2014/091377 | A1 | | 6/2014 | |

* cited by examiner

SPACER ELEMENT FOR A DISPOSABLE FORMWORK FOR THE CONSTRUCTION OF WALLS AND DISPOSABLE FORMWORK INCORPORATING THE SPACER ELEMENT

BACKGROUND OF THE INVENTION

Field of the Invention

The present invention relates to a spacer element for a disposable formwork and a disposable formwork incorporating such spacer element, wherein said formwork is intended in particular for the construction of walls, specifically both exterior enclosure walls and interior partition walls.

Description of the Related Art

Various types of disposable formworks are known for the construction of walls.

A first example of a formwork for the construction of concrete walls is shown in international patent application no. WO 2014/091377, which actually refers to a disposable formwork comprising a plurality of opposing modular panels and a series of connecting means provided for coupling two panels arranged opposing one another at a certain distance from one another.

Such connecting means display a rectilinear overturned "U" shape, wherein the two respective end portions are engaged within slots formed on the inside part of the same panels.

Another modular formwork solution is described in international patent application no. WO 2014/042502.

This formwork is formed by a series of panels arranged opposing one another and held together by various rows of spacer elements having a substantially rectangular shape, in which two through holes are afforded, arranged one above the other.

Formworks of the known type, however, have various drawbacks and technical limits mainly connected with their use on the site.

After the cement-based mortar has been cast in the formworks, there is normally a slow and inadequate setting of the cement-based mortar itself.

A further example of a disposable formwork is shown in Italian patent application no. AN2015A000011 by the same Applicant, which, in fact, discloses a formwork substantially comprising two perforated panels, arranged opposing one another and joined through a series of spacer members.

BRIEF SUMMARY OF THE INVENTION

The object of the present invention is to overcome the problems of the prior art highlighted above and to further perfect the technical solution proposed by the same Applicant in Italian patent application no. AN2015A000011.

Another object of the invention is to provide a spacer element for a disposable formwork for the construction of walls, that contributes to obtaining a wall with high mechanical resistance characteristics.

Another object of the invention is to provide a spacer element for a disposable formwork for the construction of walls, that allows the time required for obtaining the finished wall to be reduced.

Therefore, the specific subject matter of the present invention is a spacer element for a disposable formwork for the construction of a wall, said formwork being of the type comprising a first panel and a second panel, said spacer element being configured for mutually coupling said first panel and said second panel arranged at a certain distance one from the other, said spacer element comprising: a first connecting portion configured to be coupled, in use, to said first panel; a second connecting portion opposite said first connecting portion and configured to be coupled, in use, to said second panel; and at least one pipe provided with at least one lateral opening communicating, in use, with the outside of said formwork; in said at least one pipe there being afforded at least one through hole communicating, in use, with an inner part of said formwork in such a way as to allow the flow of air from the outside of the formwork toward said inside part and the outflow of liquids from said inside part toward the outside of the formwork.

Advantageously, according to the invention, said first connecting portion may comprise a first connecting means and said second connecting portion may comprise a second connecting means.

Furthermore, according to the invention, said first connecting means and said second connecting means may be formed in a single piece with said at least one pipe.

Preferably according to the invention, said at least one through hole in said at least one pipe may comprise at least one row of through holes arranged longitudinally to said at least one pipe.

Furthermore, according to the invention, said at least one through hole may have a diameter less than or equal to 3 mm.

Preferably according to the invention, said at least one lateral opening may comprise at least a first lateral opening arranged at said first connecting portion, and at least a second lateral opening arranged at said second connecting portion.

Again according to the invention, said at least one pipe may have a first internal slope toward said at least one first lateral opening and a second internal slope toward said at least one second lateral opening.

Preferably according to the invention, said at least one pipe may comprise three pipes mutually spaced apart and substantially parallel.

Advantageously, according to the invention, said spacer element may comprise a lower engagement portion configured to be coupled, in use, to a lower alignment element.

Furthermore, according to the invention, said spacer element may comprise an upper engagement portion configured to be coupled, in use, to an upper alignment element.

Advantageously, according to the invention, in an intermediate zone of said at least one pipe, an interruption element may be provided to prevent the heat bridge phenomenon.

The subject matter of the present invention is also a disposable formwork for the construction of a wall, said formwork comprising two panels and at least one spacer element of the type indicated above, arranged between said two panels so as to couple said two panels.

Advantageously, according to the invention, in at least one panel of said two panels at least one opening may be afforded, communicating with said at least one lateral opening of said at least one pipe.

BRIEF DESCRIPTION OF THE DRAWINGS

Characteristics and advantages will become more apparent in the following description of a preferred but not exclusive embodiment shown by way of a non-limiting example in the appended drawings, wherein.

DETAILED DESCRIPTION OF THE PREFERRED EMBODIMENTS

With reference to the enclosed figures, 1 indicates a modular disposable formwork for the construction of walls of buildings, specifically both exterior enclosure walls and interior partition walls.

The formwork 1 comprises a first panel 2 and a second panel 3 of a substantially square or rectangular shape, and a plurality of spacer elements 4 arranged between said first panel 2 and second panel 3.

The spacer elements 4, like the first panel 2 and the second panel 3, are preferably made of plastic materials.

The first panel 2 and the second panel 3 each have a first side 5*a* and a second side 5*b* opposite to said first side 5*a*.

Figure 1:
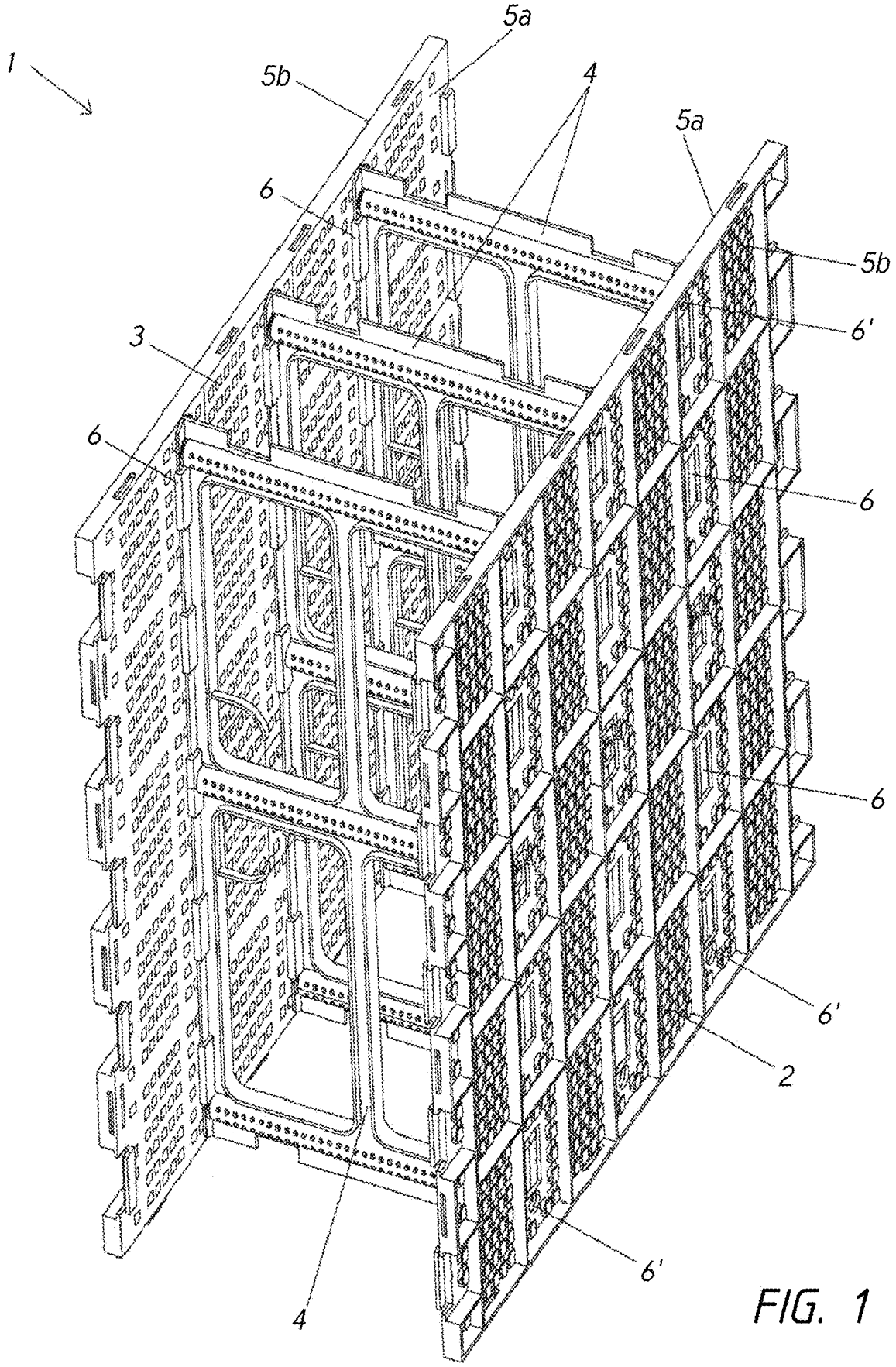
FIG. 1 shows a disposable formwork incorporating a plurality of spacer elements, according to the present invention.
Figure 2:
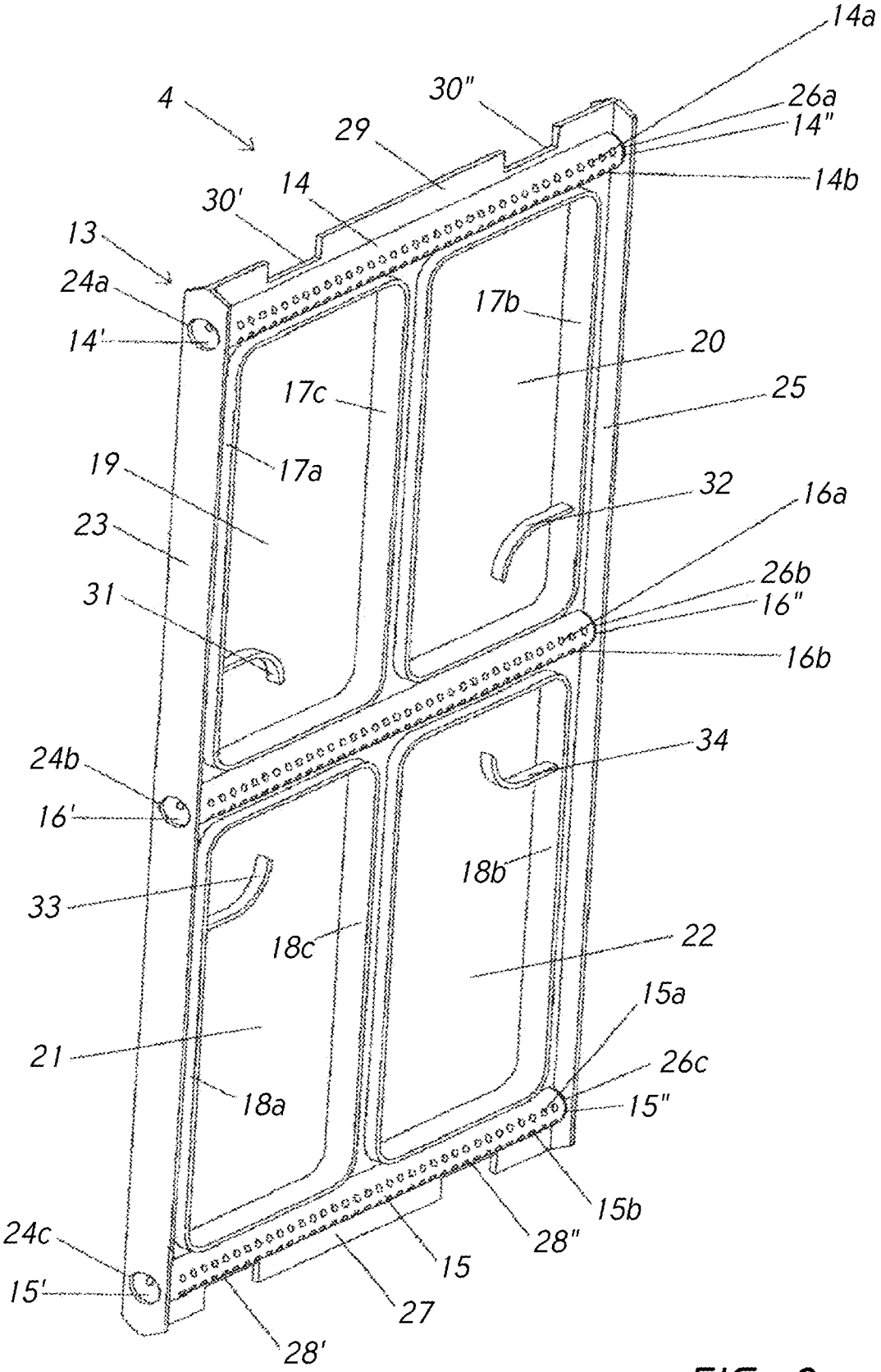
FIG. 2 is an axonometric view of a spacer element according to a first embodiment of the present invention.
Figure 3:
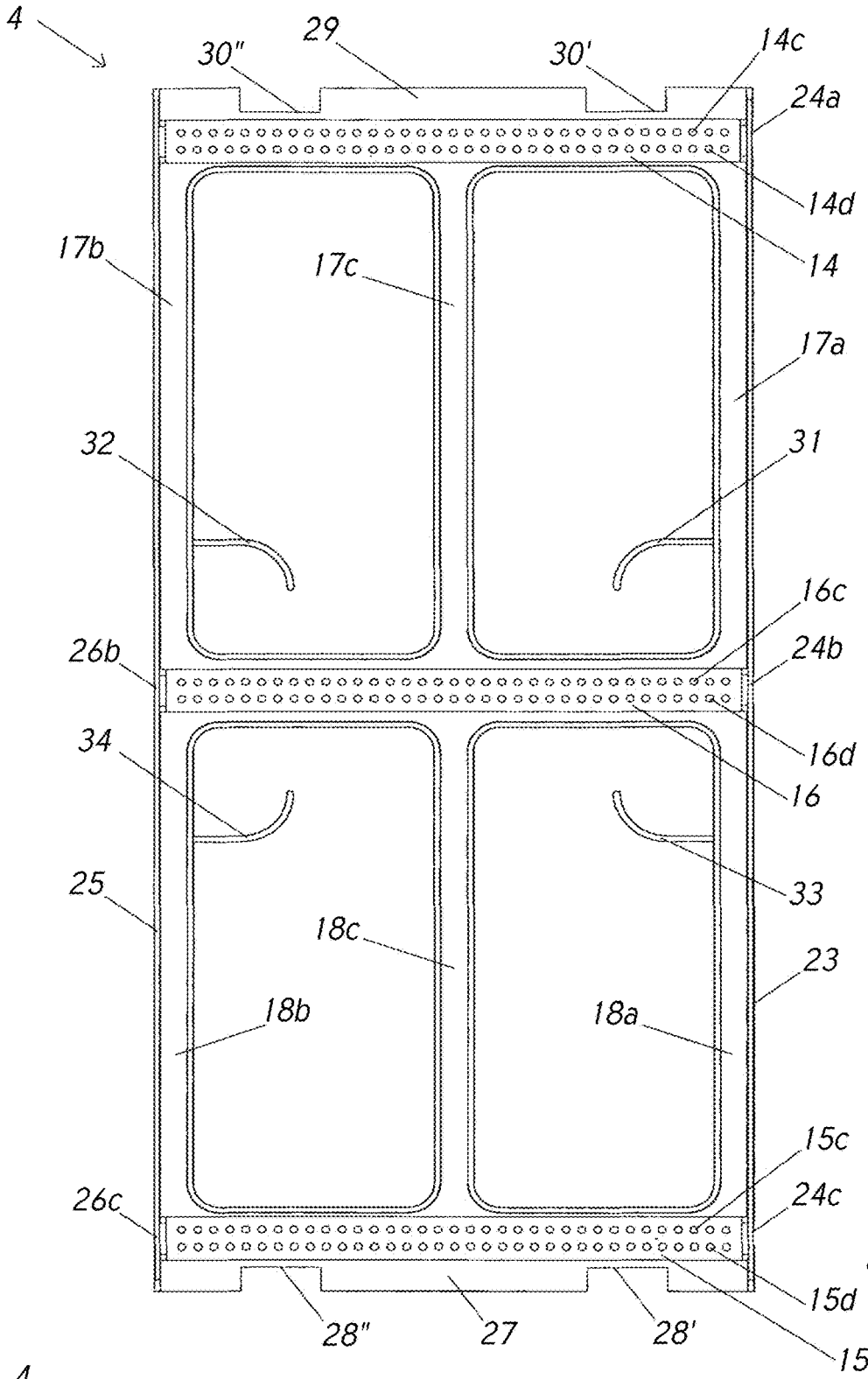
FIG. 3 is a lateral view of the spacer element according to FIG. 2.
Figure 4:
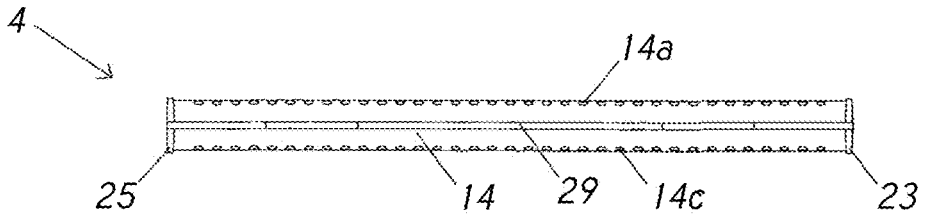
FIG. 4 is a plan view from above of the spacer element according to FIGS. 2 and 3.

In the assembled configuration of the formwork 1 shown in FIG. 1, the first panel 2 and the second panel 3 are opposing one another, i.e. with the respective first sides 5*a* mutually facing one another.

On the first side 5*a* of each of said panels 2, 3 a plurality of guides 6 is provided, arranged on various vertically aligned rows, which perform the function of enabling the connection with the aforementioned plurality of spacer elements 4.

Each guide 6 is formed by two L-shaped tabs 6*a*, 6*b*, arranged opposing one another so as to form an empty space 7 between them, open at the top through a first horizontal slit 8, at the bottom through a second horizontal slit 9, on the first side 5*a* through a third vertical slit 10 and on the second side 5*b* with a fourth opening 11.

Each of said first panel 2 and second panel 3 further has a series of openings 6' for allowing the ventilation of the inside part of the formwork 1 and the outflow of liquids from the latter after the concrete has been cast in the formwork 1 itself, as better specified below.

On the first panel 2 and on the second panel 3, ventilation openings 12 are also afforded, for allowing the ventilation of the cement-based mortar after it has been cast in the formwork 1.

On the perimetral edges of each of said first panel 2 and second panel 3, there are portions conformed like connecting elements to allow connection with other panels of the type described above, both in the vertical and horizontal direction.

Now, with reference to FIG. 1, the spacer elements 4 are of the same number as the vertical rows of guides 6 provided on each panel.

In the specific case shown in the enclosed figures, there are three spacer elements 4.

As mentioned above, the spacer elements 4 are interposed between the first panel 2 and the second panel 3.

Each spacer element 4 is formed by a frame 13 comprising three mutually parallel cross members, i.e. an upper cross member 14, a lower cross member 15 and a central cross member 16 arranged in a substantially equidistant position with respect to the upper cross member 14 and the lower cross member 15.

The upper cross member 14, the lower cross member 15 and the central cross member 16 are each formed by a pipe defining respectively a first lateral opening 14', 15', 16' and a second lateral opening 14", 15", 16", for the ventilation of the inner part of the formwork 1 and the outflow of liquids, and in which four respective longitudinal rows of through holes 14*a*, 14*b*, 14*c*, 14*d*, 15*a*, 15*b*, 15*c*, 15*d*, 16*a*, 16*b*, 16*c*, 16*d* are afforded.

In particular, the first lateral openings 14', 15', 16' provided on one side of the spacer element 4, like the second lateral openings 14", 15", 16" provided on the other side, are arranged so that, in the assembled configuration of the formwork 1, they are each facing towards the openings 6'.

Each hole of the aforementioned longitudinal rows of through holes 14*a*, 14*b*, 14*c*, 14*d*, 15*a*, 15*b*, 15*c*, 15*d*, 16*a*, 16*b*, 16*c*, 16*d* preferably has a diameter less than or equal to 3 mm.

The inside part of the upper cross member 14, the lower cross member 15 and the central cross member 16 are not perfectly straight; they each have two opposing slopes that originate from the respective central zone, lowering towards the relative ends, to facilitate the outflow of liquids towards the outside, as better specified below.

The frame 13 further comprises a set of three upper uprights comprising a first lateral upper upright 17*a*, a second lateral upper upright 17*b* and a central upper upright 17*c*, which extend perpendicularly from the central cross member 16 to the upper cross member 14.

The frame 13 also comprises a set of three lower uprights formed by a first lateral lower upright 18*a*, a second lateral lower upright 18*b* and a central lower upright 18*c*, which extend perpendicularly from the central cross member 16 to the lower cross member 15.

In particular, the first lateral upper upright 17*a*, the second lateral upper upright 17*b* and the central upper upright 17*c* are respectively aligned with the first lateral lower upright 18*a*, the second lateral lower upright 18*b* and the central lower upright 18*c*, so as to form, together with the upper cross member (14, the lower cross member 15 and the central cross member 16, four empty spaces 19, 20, 21, 22 of a substantially identical shape.

On a first lateral edge of the spacer element 4, at the first lateral upper upright 17*a* and at the first lateral lower upright 18*a*, a first flat element 23 is provided, arranged in the most external position with respect to the first lateral openings 14', 15', 16' of the pipes of the cross members 14, 15, 16, so that respective slits are formed between the cross members 14, 15, 16 and the first flat element 23.

Furthermore, in the first flat element 23 three first openings 24*a*, 24*b*, 24*c* are afforded, respectively arranged substantially opposite the first lateral openings 14', 15', 16' of the pipes of the cross members 14, 15, 16.

Likewise, on a second lateral edge of the spacer element 4, opposite the aforementioned first lateral edge, there is a second flat element 25 arranged parallel to the first flat element 23 and in a more external position with respect to the second lateral openings 14", 15", 16" of the pipes of the cross members 14, 15, 16, so that, also in this case, respective slits are formed between the cross members 14, 15, 16 and the second flat element 25.

In the second flat element 25 three second openings 26*a*, 26*b*, 26*c* are also provided, respectively positioned substantially opposite the second lateral openings 14", 15", 16" of the pipes of the cross members 14, 15, 16.

In the lower part of the lower cross member 15 a lower engagement portion 27 is provided, from whose lower edge two lower openings 28', 28" extend, of a substantially rectangular shape.

Likewise, in the upper part of the upper cross member 14 an upper engagement portion 29 is provided, from whose upper edge two upper openings 30', 30" extend, of a substantially rectangular shape.

The lower openings 28', 28" and the upper openings 30', 30" are adapted to engage with respective complementary elements (not shown in the enclosed claims) arranged longitudinally with respect to the formwork 1, for the purpose of performing the alignment in the space of all the spacer elements 4.

In each of the empty spaces 19, 20, 21, 22 a curved appendage 31, 32, 33, 34 is provided, which extends, respectively, from said first lateral upper upright 17*a*, second lateral upper upright 17*b*, first lateral lower upright 18*a* and second lateral lower upright 18*b*, towards the central cross member 16.

Such curved appendages 31, 32, 33, 34 act as guides for the passage of pipes and/or cables for installations of any kind, the latter being able to pass into the formwork 1 in the spaces defined by them, before the cement-based mortar is cast.

Each spacer element 4 is formed in a single piece.

For the assembly of the formwork 1, the spacer elements 4 must be coupled to the corresponding vertical rows of guides 6 provided on the first panel 2 and on the second panel 3, by inserting the first flat element 23 into the housings 7 identified by the guides 6 of one of said panels, and making the second flat element 25 pass into the housings 7 identified by the guides 6 of the other panel, so that said panels 2, 3 are arranged parallel to one another and opposing one another.

Once the entire structure of formworks 1 has been built for the construction of the wall, by coupling them appropriately in the horizontal and/or vertical direction, the cement-based mortar can be cast in the formworks 1 which comprise such structure, and then the surface finishing works on the wall being built can be performed.

At this point, it is necessary to wait for the cement-based mortar used for the finished wall to set completely.

Figure 5:
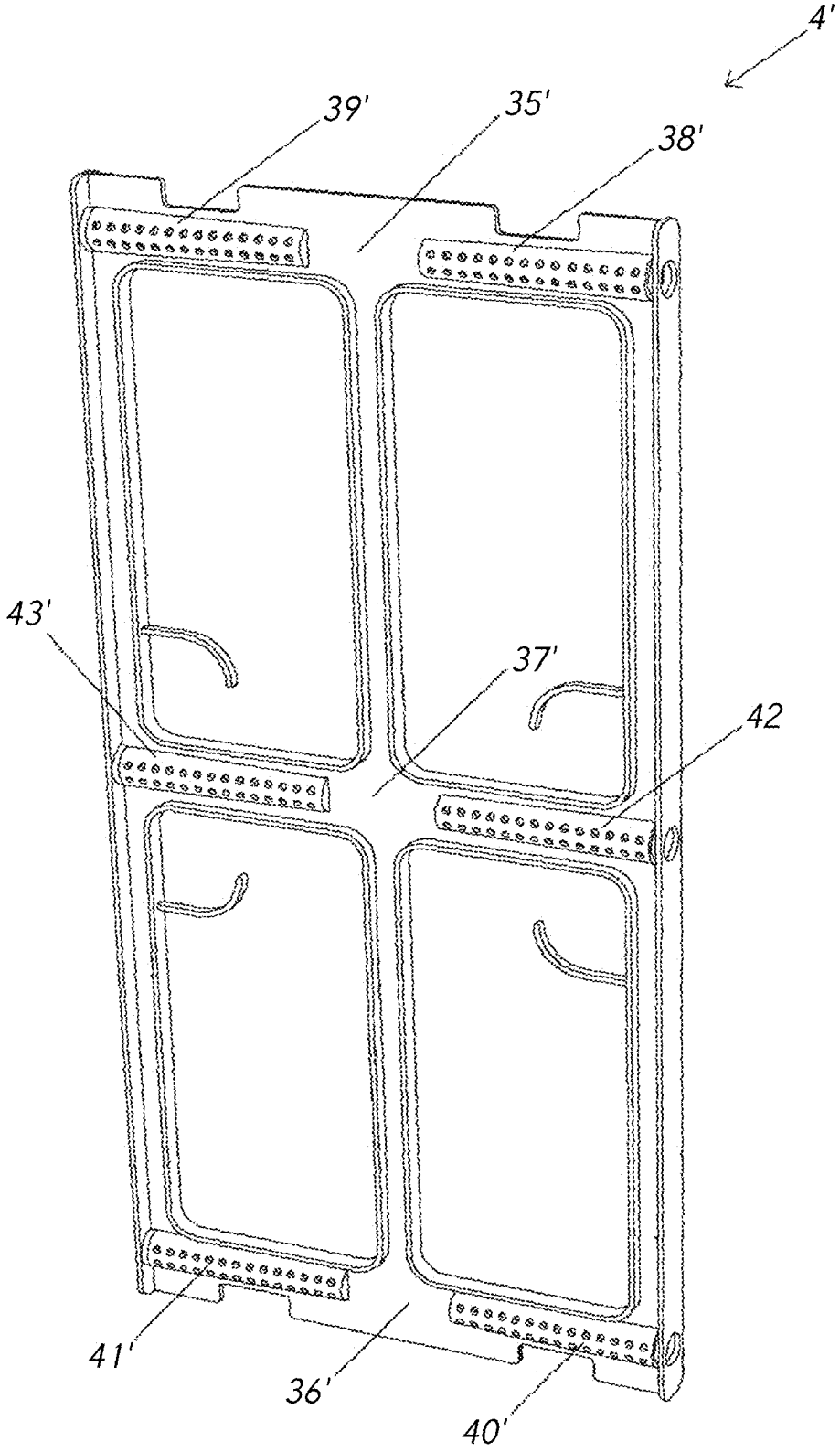
FIG. 5 is a perspective view of a spacer element in a second embodiment of the present invention.
Figure 6:
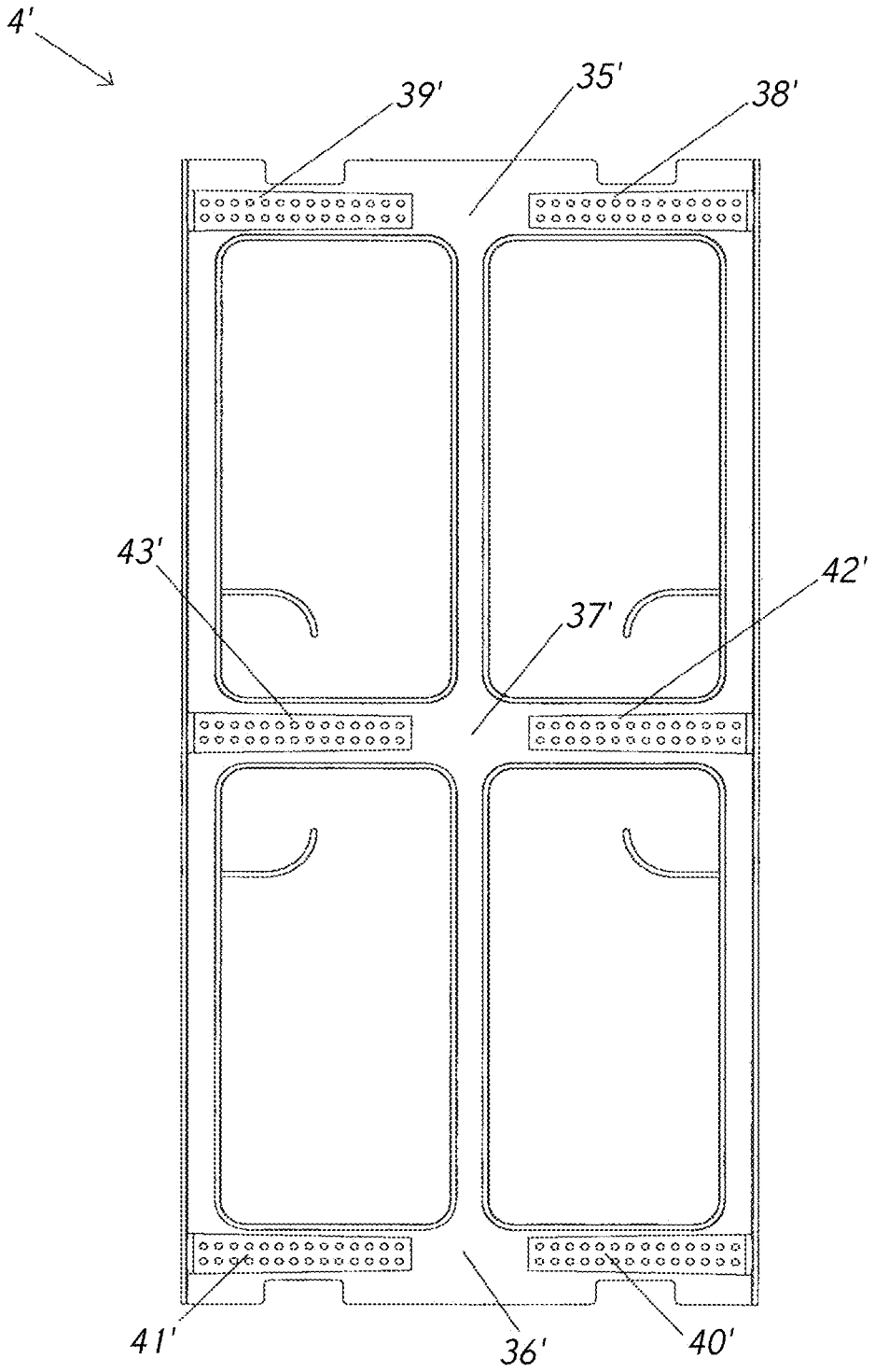
FIG. 6 is a lateral view of the spacer element shown in FIG. 5.
Figure 7:
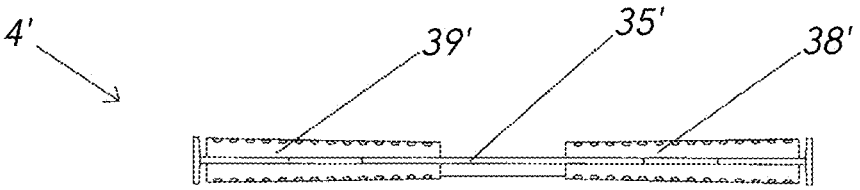
FIG. 7 is a plan view from above of the spacer element according to FIGS. 5 and 6.
Figure 8:
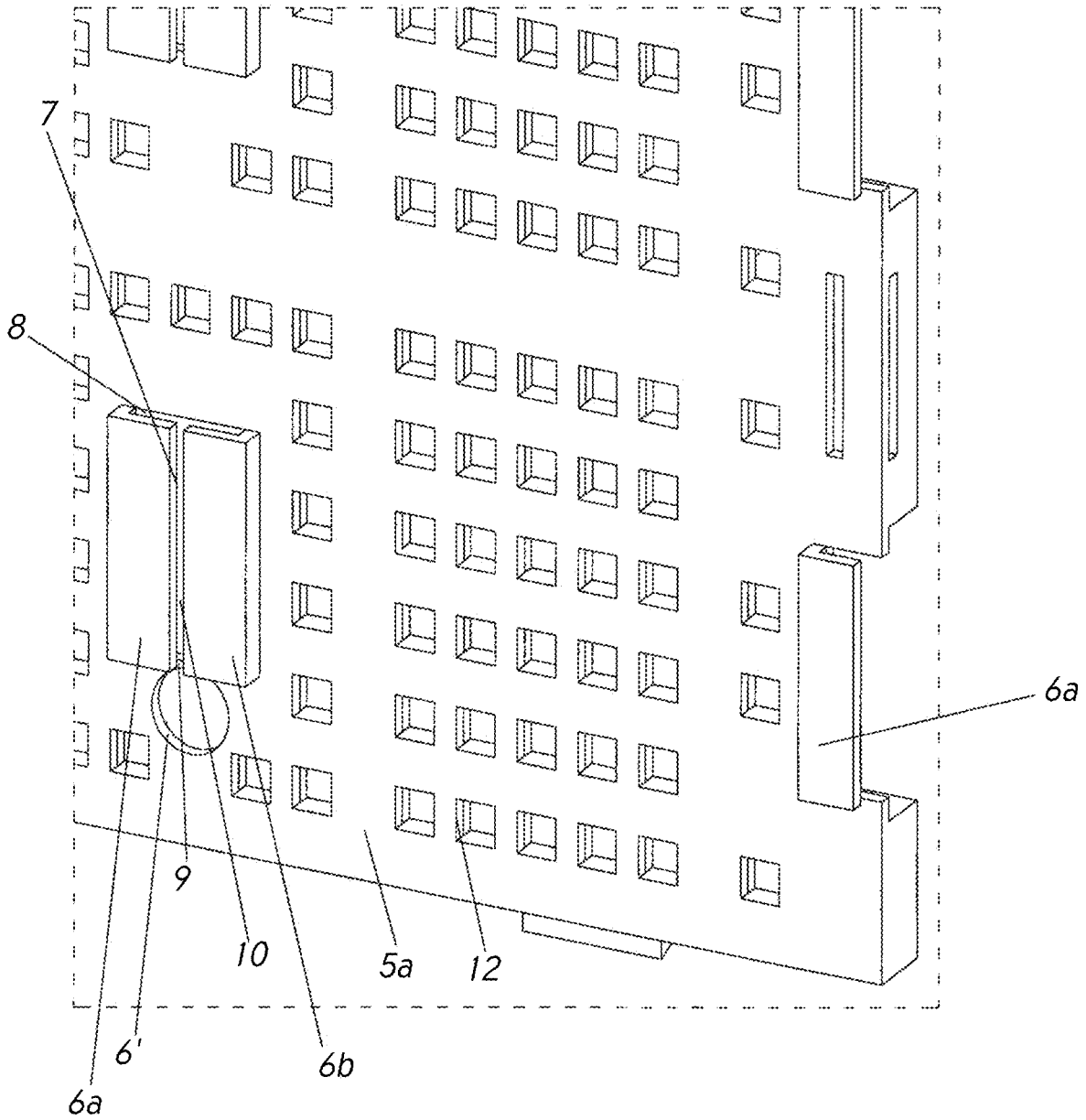
FIG. 8 is a detailed view of a first side of a panel of the disposable formwork shown in FIG. 1.
Figure 9:
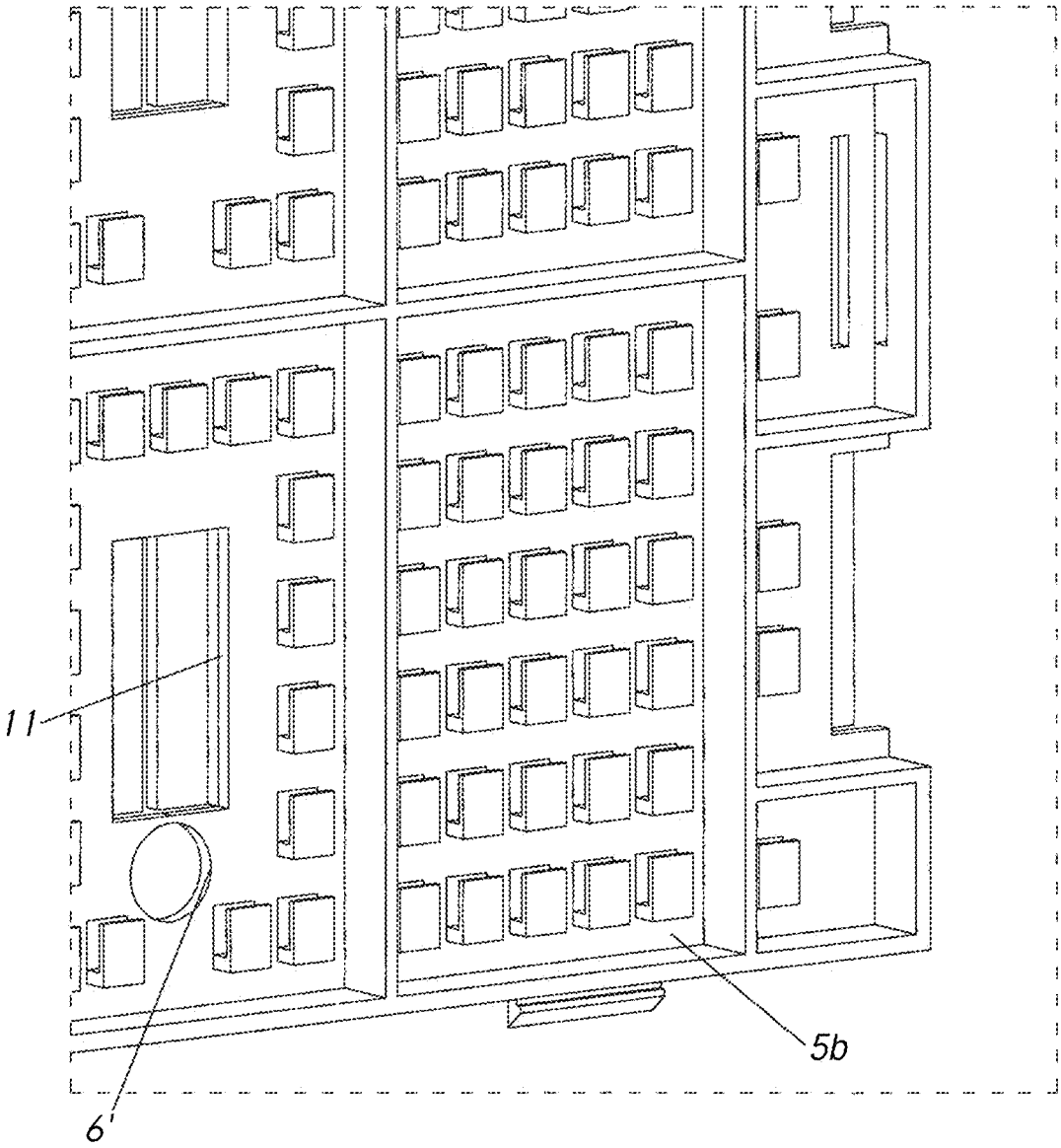
FIG. 9 is a detailed view of a second side of a panel of the disposable formwork illustrated in FIG. 1.

Now, with specific reference to FIGS. 5, 6 and 7, number 4' indicates a further spacer element, still according to the present invention.

Such spacer element 4' has an identical structure to that of the above-described spacer element 4 except that the pipes of the three cross members have a respective interruption 35', 36', 37' in the relative central part so that each pipe is, in fact, configured as a pair of pipes 38', 39'; 40', 41'; 42', 43' separate from one another and closed in the respective face facing towards the inside of the spacer element 4', so as not to be communicating with one another.

The provision of such interruptions 35', 36', 37' allows the particularly unwanted phenomenon of heat bridges to be prevented, which would otherwise arise in the finished construction.

Whereas, in relation to the methods for assembling the formwork 1 in the event of using the spacer elements 4' they remain the same as those indicated above with reference to the spacer elements 4.

When using the formworks 1 described above for the construction of a wall, a double effect has surprisingly been found, i.e. a significant reduction in the setting times of the cement-based mortar and a net improvement in the mechanical and structural performance of the wall itself due to a more homogeneous and uniform setting process of the wall.

Such double effect arises due to the provision of the above-described cross members 14, 15, 16 in each spacer element 4, which on one hand allow the liquid products of the cement-based water to flow out of the formwork 1 from the openings 14', 14", 15', 15", 16', 16" passing through the through holes 14*a*, 14*b*, 14*c*, 14*d*, 15*a*, 15*b*, 15*c*, 15*d*, 16*a*, 16*b*, 16*c*, 16*d*, and on the other hand allow the air in the external environment to reach the inside part of the formwork 1 passing into the pipes comprising the cross members 14, 15, 16, in order to promote the drying and therefore the setting of the cement-based mortar.

The above is intended to provide an exemplificative and non-limitative description, therefore any construction variations are considered to fall within the scope of protection of the present technical solution as described above and claimed below.

The invention claimed is:

1. A disposable formwork for construction of a wall, said formwork comprising:

two panels; and at least one spacer element disposed between said two panels to couple said two panels, said spacer element being configured to mutually couple said first panel and the second panel to each other with a specified distance therebetween, said spacer element comprising:

a first connecting portion configured to be coupled, in use, to said first panel, a second connecting portion opposite to said first connecting portion and configured to be coupled, in use, to said second panel, and at least one pipe including an upper portion and side surfaces connected to the upper portion, the at least one pipe provided with at least one lateral opening communicating, in use, with the outside of said formwork, said at least one pipe being provided with a plurality of through holes extending in relation to one another along a longitudinal length of the at least one pipe, the plurality of through holes being disposed along at least one of the side surfaces of the at least one pipe, the plurality of through holes communicating, in use, with an inner part of said formwork to allow the flow of air from the outside of the formwork directly toward said inner part and the outflow of liquids from said inner part directly toward the outside of the formwork, wherein at least one opening is provided in at least one panel of the two panels, the at least one opening communicating with said at least one lateral opening of said at least one pipe.

* * * * *